US011845291B2

(12) United States Patent
Aimono

(10) Patent No.: US 11,845,291 B2
(45) Date of Patent: Dec. 19, 2023

(54) LIQUID DISCHARGE APPARATUS AND CONTROL METHOD FOR LIQUID DISCHARGE APPARATUS

(71) Applicant: Seiko Epson Corporation, Tokyo (JP)

(72) Inventor: Takanori Aimono, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 73 days.

(21) Appl. No.: 17/646,225

(22) Filed: Dec. 28, 2021

(65) Prior Publication Data

US 2022/0203695 A1 Jun. 30, 2022

(30) Foreign Application Priority Data

Dec. 28, 2020 (JP) ..... 2020-218872

(51) Int. Cl.

| | |
|---|---|
| ***B41J 2/175*** | (2006.01) |
| ***B41J 2/525*** | (2006.01) |
| ***B41J 2/21*** | (2006.01) |
| ***B41J 2/14*** | (2006.01) |

(52) U.S. Cl.

CPC ..... *B41J 2/17596* (2013.01); *B41J 2/14201* (2013.01); *B41J 2/2107* (2013.01); *B41J 2/525* (2013.01)

(58) Field of Classification Search

CPC .. B41J 2/17596; B41J 2/14201; B41J 2/2107; B41J 2/525; B41J 2/17509; B41J 2/195; B41J 2002/14419; B41J 2/14233; B41J 2202/12; B41J 2/01; B41J 2/17503; B41J 2/18

See application file for complete search history.

(56) References Cited

FOREIGN PATENT DOCUMENTS

JP 2019-014194 1/2019

OTHER PUBLICATIONS

Yonehara, Tsubasa, "Liquid Jet Head, Liquid Jet Recording Device, Control Method of the Liquid Jet Head, and Control Program of the Liquid Jet Head", Jan. 31, 2019, Entire Document (Year: 2019).*

* cited by examiner

*Primary Examiner* — Lisa Solomon
(74) *Attorney, Agent, or Firm* — WORKMAN NYDEGGER

(57) ABSTRACT

When a first liquid containing the particles whose particle size average value is a first particle size is supplied to the liquid discharge head, the control device controls the circulation mechanism so that a circulation flow rate of the first liquid in the supply flow path, the nozzle flow path, and the discharge flow path is a first flow rate. When a second liquid containing the particles whose particle size average value is a second particle size larger than the first particle size is supplied to the liquid discharge head, the control device controls the circulation mechanism so that the circulation flow rate of the second liquid is a second flow rate lower than the first flow rate.

11 Claims, 9 Drawing Sheets

FIG. 11

| VISCOSITY VC [mPa・s] | DISCHARGE RATE VA [m²/s] | PARTICLE SIZE PS [μm] | CIRCULATION FLOW RATE [m²/s] |
|---|---|---|---|
| 1 | 3.00E−12 | PS≦4 | 9.30E−11 |
| | | 4<PS≦6 | 6.40E−11 |
| | | 6<PS≦10 | 1.80E−11 |
| | | 11<PS≦15 | 7.30E−12 |
| | | 15<PS | 2.40E−12 |

FIG. 12

| PARTICLE SIZE PS [μm] | DISCHARGE RATE VA [m²/s] | VISCOSITY VC [mPa・s] | CIRCULATION FLOW RATE [m²/s] |
|---|---|---|---|
| 5 | 3.00E−12 | VC≦3 | 6.40E−11 |
| | | 3<VC≦10 | 1.50E−10 |
| | | 10<VC≦20 | 6.70E−10 |
| | | 20<VC≦30 | 3.90E−09 |
| | | 30<VC | 9.80E−09 |

FIG. 13

| PARTICLE SIZE PS [μm] | DISCHARGE RATE VA [m²/s] | VISCOSITY VC [mPa・s] | CIRCULATION FLOW RATE [m²/s] |
|---|---|---|---|
| 8 | 3.00E−12 | VC≦3 | 1.80E−11 |
| | | 3<VC≦10 | 7.70E−11 |
| | | 10<VC≦20 | 2.30E−10 |
| | | 20<VC≦30 | 8.80E−10 |
| | | 30<VC | 3.00E−09 |

FIG. 14

| PARTICLE SIZE PS [μm] | VISCOSITY VC [mPa·s] | DISCHARGE RATE VA [m²/s] | CIRCULATION FLOW RATE [m²/s] |
|---|---|---|---|
| 5 | 1 | VA≤1E−12 | 8.20E−12 |
| | | 1E−12<VA≤1E−11 | 6.40E−11 |
| | | 1E−11<VA≤1E−10 | 4.50E−10 |
| | | 1E−10<VA | 1.20E−09 |

FIG. 15

| PARTICLE SIZE PS [μm] | VISCOSITY VC [mPa·s] | DISCHARGE RATE VA [m²/s] | CIRCULATION FLOW RATE [m²/s] |
|---|---|---|---|
| 8 | 1 | VA≤1E−12 | 2.70E−12 |
| | | 1E−12<VA≤1E−11 | 1.80E−11 |
| | | 1E−11<VA≤1E−10 | 9.60E−09 |
| | | 1E−10<VA | 7.80E−08 |

FIG. 16

| PARTICLE SIZE PS [μm] | VISCOSITY VC [mPa·s] | DISCHARGE RATE VA [m²/s] | CIRCULATION FLOW RATE [m²/s] |
|---|---|---|---|
| 5 | 4 | VA≤1E−12 | 3.30E−11 |
| | | 1E−12<VA≤1E−11 | 1.50E−10 |
| | | 1E−11<VA≤1E−10 | 9.80E−10 |
| | | 1E−10<VA | 5.60E−09 |

LIQUID DISCHARGE APPARATUS AND CONTROL METHOD FOR LIQUID DISCHARGE APPARATUS

The present application is based on, and claims priority from JP Application Serial Number 2020-218872, filed Dec. 28, 2020, the disclosure of which is hereby incorporated by reference herein in its entirety.

BACKGROUND

1. Technical Field

The present disclosure relates to a liquid discharge apparatus and a control method thereof.

2. Related Art

In a liquid injection head, in order to improve stability of a liquid discharge operation, a technique is known in which a circulation amount of a liquid is increased in accordance with an increase in a liquid discharge rate per unit time (for example, JP-A-2019-14194).

According to the technique in the related art, physical characteristics of a discharged liquid are not taken into consideration, and liquid performance may deteriorate.

SUMMARY

According to a first aspect of the present disclosure, there is provided a liquid discharge apparatus including a liquid discharge head that discharges a liquid containing a particle, a circulation mechanism that adjusts a flow rate of the liquid circulated in the liquid discharge head, and a control device that controls an operation of the circulation mechanism. In the liquid discharge apparatus, the liquid discharge head includes a pressure chamber for applying a pressure to the liquid, a supply flow path communicating with the pressure chamber, a nozzle flow path communicating with the supply flow path, a nozzle provided in the nozzle flow path to discharge the liquid by the pressure applied in the pressure chamber, and a discharge flow path coupled to an opposite side via the nozzle in the nozzle flow path. When a first liquid containing the particles whose particle size average value is a first particle size is supplied to the liquid discharge head, the control device controls the circulation mechanism so that a circulation flow rate of the first liquid in the supply flow path, the nozzle flow path, and the discharge flow path is a first flow rate. When a second liquid containing the particles whose particle size average value is a second particle size larger than the first particle size is supplied to the liquid discharge head, the control device controls the circulation mechanism so that the circulation flow rate of the second liquid is a second flow rate lower than the first flow rate.

According to a second aspect of the present disclosure, there is provided a liquid discharge apparatus including a liquid discharge head that discharges a liquid containing a particle, a circulation mechanism that adjusts a flow rate of the liquid circulated in the liquid discharge head, and a control device that controls an operation of the circulation mechanism. In the liquid discharge apparatus, the liquid discharge head includes a pressure chamber for applying a pressure to the liquid, a supply flow path communicating with the pressure chamber, a nozzle flow path communicating with the supply flow path, a nozzle provided in the nozzle flow path to discharge the liquid by the pressure applied in the pressure chamber, and a discharge flow path coupled to an opposite side via the nozzle in the nozzle flow path. When a first liquid having a first viscosity is supplied to the liquid discharge head, the control device controls the circulation mechanism so that a circulation flow rate of the first liquid in the nozzle flow path is a first flow rate. When a fourth liquid having a second viscosity which is a viscosity higher than the first viscosity is supplied to the liquid discharge head, the control device controls the circulation mechanism so that the circulation flow rate is a fourth flow rate higher than the first flow rate.

According to a third aspect of the present disclosure, there is provided for a control method for a liquid discharge apparatus. The control method for the liquid discharge apparatus includes setting a circulation flow rate of a first liquid inside a liquid discharge head to a first flow rate, when the first liquid is supplied to the liquid discharge head, the first liquid containing particles whose particle size average value is a first particle size, and setting a circulation flow rate of a second liquid inside the liquid discharge head to a second flow rate lower than the first flow rate, when the second liquid is supplied to the liquid discharge head, the second liquid containing particles whose particle size average value is a second particle size larger than the first particle size.

According to a fourth aspect of the present disclosure, there is provided a control method for a liquid discharge apparatus is provided. The control method of the liquid discharge apparatus includes setting a circulation flow rate of a first liquid inside a liquid discharge head to a first flow rate, when the first liquid having a first viscosity is supplied to the liquid discharge head, and setting a circulation flow rate of a fourth liquid inside the liquid discharge head to a fourth flow rate higher than the first flow rate, when the fourth liquid having a second viscosity higher than the first viscosity is supplied to the liquid discharge head.

BRIEF DESCRIPTION OF THE DRAWINGS

FIG. 11 is a view for describing parameter settings of a liquid discharge apparatus according to Other Embodiment 1.

FIG. 12 is a view for describing parameter settings of a liquid discharge apparatus according to Other Embodiment 2.

FIG. 13 is a view for describing parameter settings of a liquid discharge apparatus according to Other Embodiment 3.

FIG. 14 is a view for describing parameter settings of a liquid discharge apparatus according to Other Embodiment 4.

FIG. 15 is a second view for describing parameter settings of the liquid discharge apparatus according to Other Embodiment 4.

FIG. 16 is a view for describing parameter settings of a liquid discharge apparatus according to Other Embodiment 5.

DESCRIPTION OF EXEMPLARY EMBODIMENTS

A. First Embodiment

Figure 1:
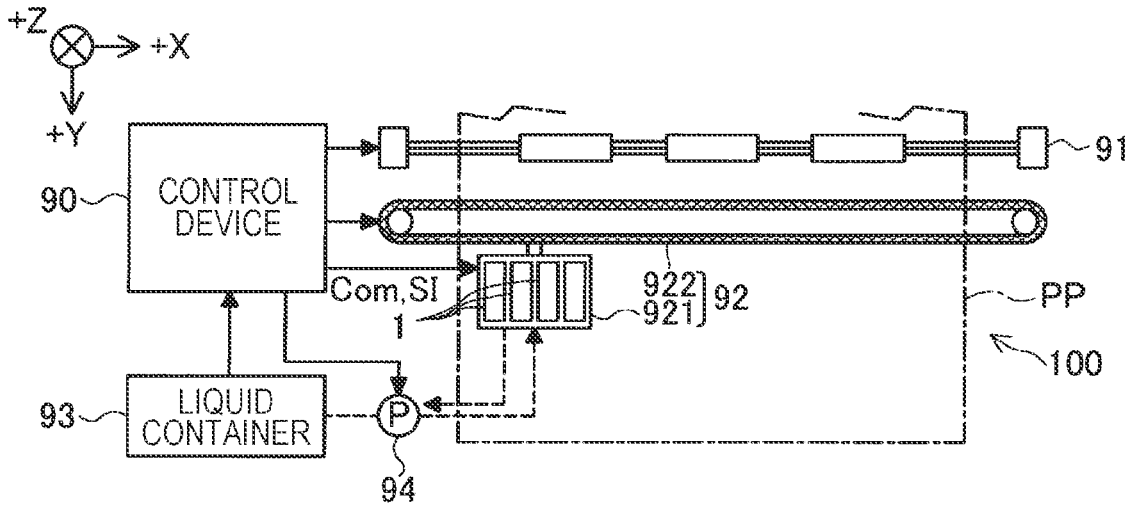
FIG. 1 is a view for describing an example of a liquid discharge apparatus according to a first embodiment.

FIG. 1 is a view for describing an example of a liquid discharge apparatus 100 according to a first embodiment. For example, the liquid discharge apparatus 100 of the first embodiment is an ink jet printing apparatus that discharges an ink onto a medium PP such as printing paper. In addition to the printing paper, any printing target such as a resin film or cloth may be used as the medium PP. FIG. 1 illustrates an X-axis direction, a Y-axis direction, and a Z-axis direction. The X-axis direction includes a +X direction and an −X direction which is a direction opposite to the +X direction. The Y-axis direction includes a +Y direction and a −Y direction which is a direction opposite to the +Y direction. The Z-axis direction includes a +Z direction and a −Z direction opposite to the +Z direction. The X-axis direction, the Y-axis direction, and the Z-axis direction are orthogonal to each other. The X-axis direction, the Y-axis direction, and the Z-axis direction which are illustrated in FIG. 1 are common to each other in the drawings subsequent to FIG. 1.

As illustrated in FIG. 1, the liquid discharge apparatus 100 includes a plurality of liquid discharge heads 1 that discharge a liquid containing a particle, one or more control devices 90, a liquid container 93, and a circulation mechanism 94. For example, the control device 90 is a microcomputer including a microprocessor such as a CPU or FPGA and a storage circuit such as a semiconductor memory. The control device 90 controls an operation of each unit of the liquid discharge apparatus 100 by executing a program stored in advance in the storage circuit.

The liquid is stored in the liquid container 93. For example, as the liquid, an ink in which a pigment serving as a coloring material is dispersed in a solvent can be used. In addition to the ink containing the pigment, the liquid may be an ink containing a dye, or an ink containing both the pigment and the dye as the coloring material. The ink includes various liquid compositions such as a general water-based ink, an oil-based ink, a gel ink, and a hot melt ink. For example, as the liquid container 93, a cartridge that can be attached to and detached from the liquid discharge apparatus 100, a bag-shaped ink pack formed of a flexible film, and an ink tank that can be refilled with the ink can be adopted.

In the present embodiment, the control device 90 can acquire information on a viscosity of the ink stored in the liquid container 93 or a particle size of the coloring material such as the pigment contained in the ink. For example, as a method for acquiring the viscosity and the particle size of the liquid by the control device 90, the control device 90 may detect the information on the viscosity or the particle size stored in advance in a chip which is not illustrated and provided in the liquid container 93. Alternatively, a user of the liquid discharge apparatus 100 may manually input the information to the control device 90. In the present embodiment, the liquid container 93 stores a plurality of types of the inks having different colors. Specifically, two types of liquids such as a first liquid and a second liquid which will be described later are individually stored in the liquid container 93.

The circulation mechanism 94 is a pump that supplies the liquid stored in the liquid container 93 to the liquid discharge head 1. In the present embodiment, the circulation mechanism 94 can select one of a plurality of types of the liquids stored in the liquid container 93 under control of the control device 90, and can supply the selected liquid to one of the liquid discharge heads 1. That is, each of the plurality of types of the liquids can be individually supplied to the liquid discharge head 1 of the present embodiment by the control device 90 switching the types of the liquids. As will be described later, the circulation mechanism 94 can adjust a circulation flow rate of the ink inside the liquid discharge head 1 under the control of the control device 90. The circulation mechanism 94 collects the ink stored inside the liquid discharge head 1, and returns the collected ink to the liquid discharge head 1.

The liquid discharge apparatus 100 of the present embodiment further includes a movement mechanism 91 and a transport mechanism 92. The movement mechanism 91 transports the medium PP toward the +Y direction under the control of the control device 90. The transport mechanism 92 includes a storage case 921 for storing the plurality of liquid discharge heads 1 and an endless belt 922 to which the storage case 921 is fixed. The transport mechanism 92 moves the liquid discharge head 1 to reciprocate along the X-axis direction by operating the endless belt 922 to which the storage case 921 is fixed under the control of the control device 90. A transport direction of the medium PP and a movement direction of the liquid discharge head 1 are not limited to an orthogonal direction, and may intersect with each other at a predetermined angle. The liquid container 93 and the circulation mechanism 94 may be stored in the storage case 921 together with the liquid discharge head 1.

As illustrated in FIG. 1, the control device 90 outputs a drive signal Com for driving the liquid discharge head 1 and a control signal SI for controlling the liquid discharge head 1 to the liquid discharge head 1. The liquid discharge head 1 is driven by the drive signal Com under the control of the control signal SI, and discharges the ink from a portion or all of a plurality of nozzles provided in the liquid discharge head 1. In the present embodiment, a discharge direction of the ink is the +Z direction. The liquid discharge head 1 discharges ink from the nozzle while the medium PP is transported by the movement mechanism 91 in conjunction with a reciprocating movement of the liquid discharge head 1 by the transport mechanism 92, and causes the ink to land on a surface of the medium PP. As a result, a desired image is formed on the surface of the medium PP. The discharge direction of the ink is not limited to the +Z direction, and may be any direction that intersects with an X-Y plane.

Figure 2:
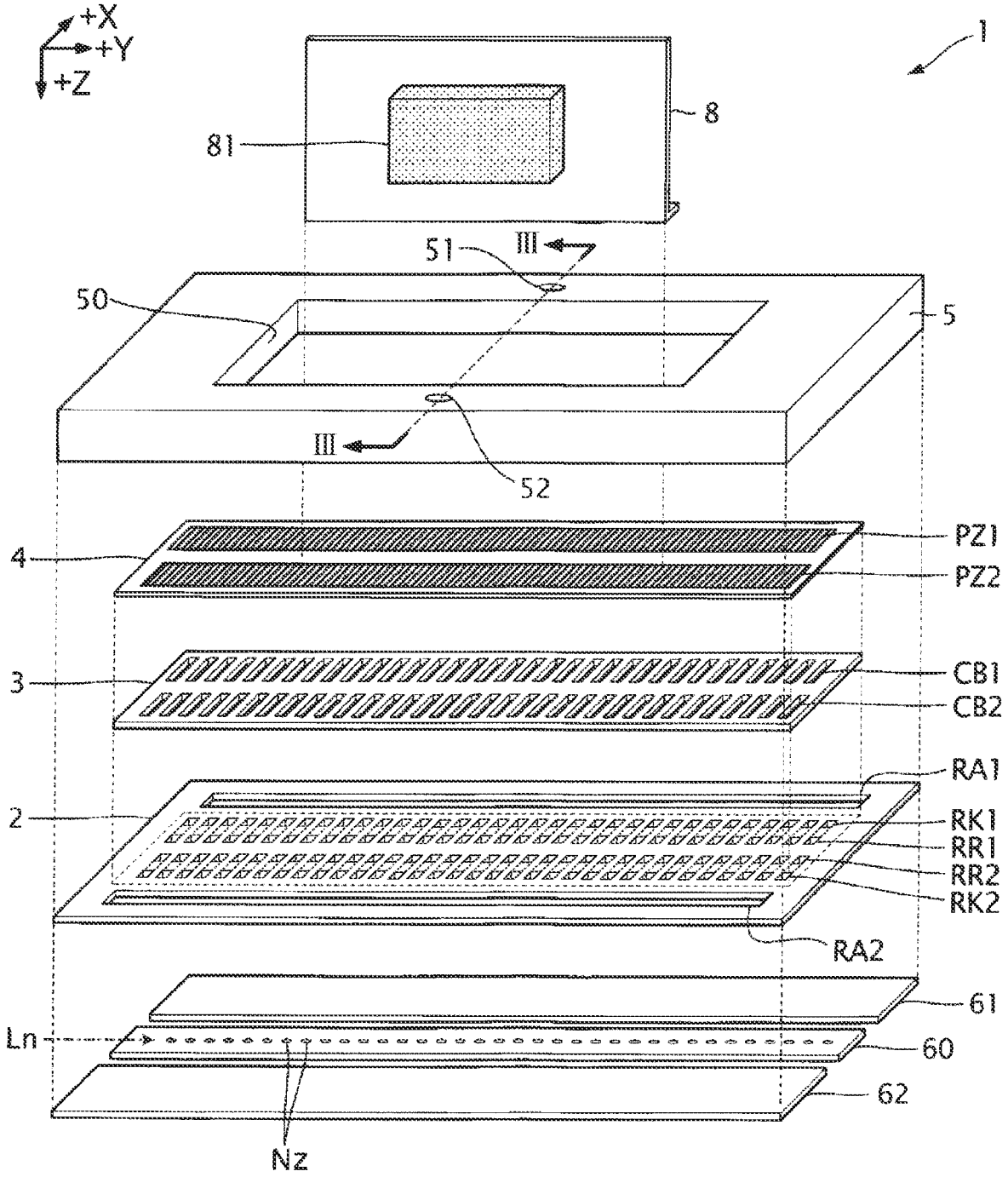
FIG. 2 is an exploded perspective view of a liquid discharge head.
Figure 3:
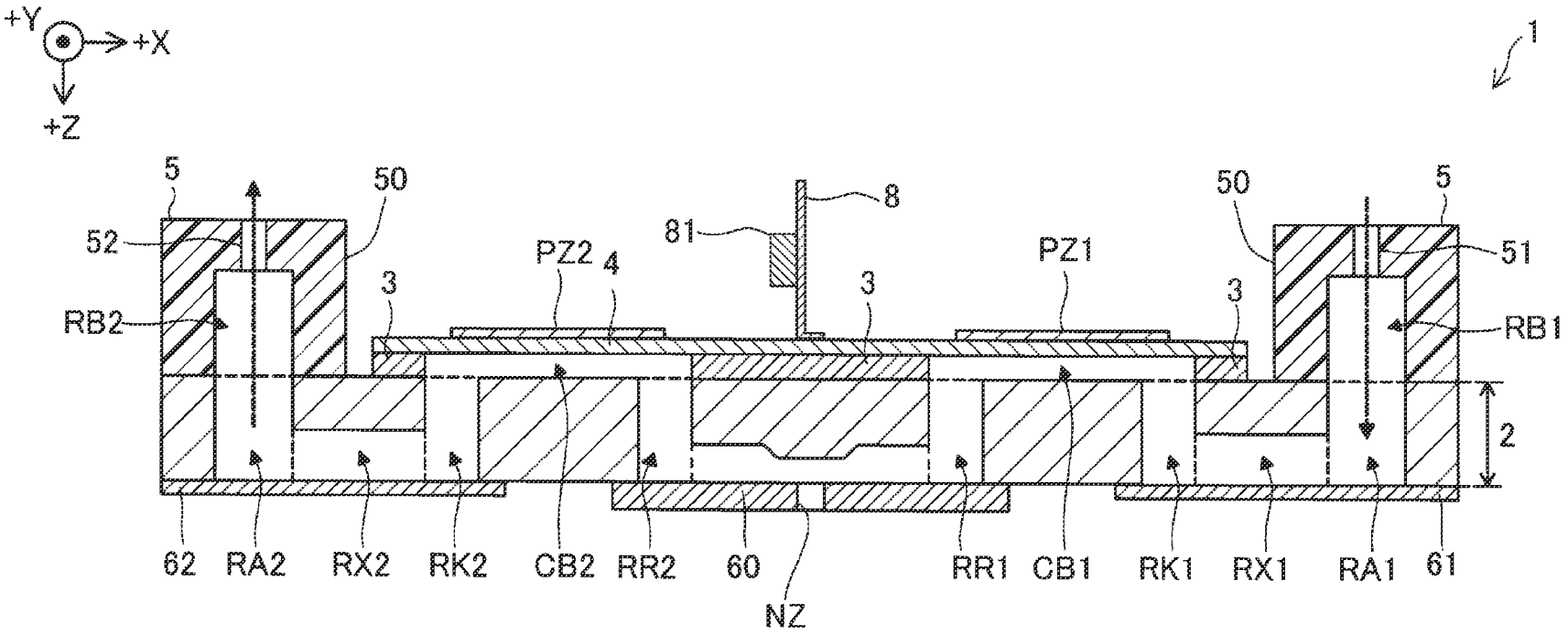
FIG. 3 is a cross-sectional view taken along line III-III in FIG. 2.
Figure 4:
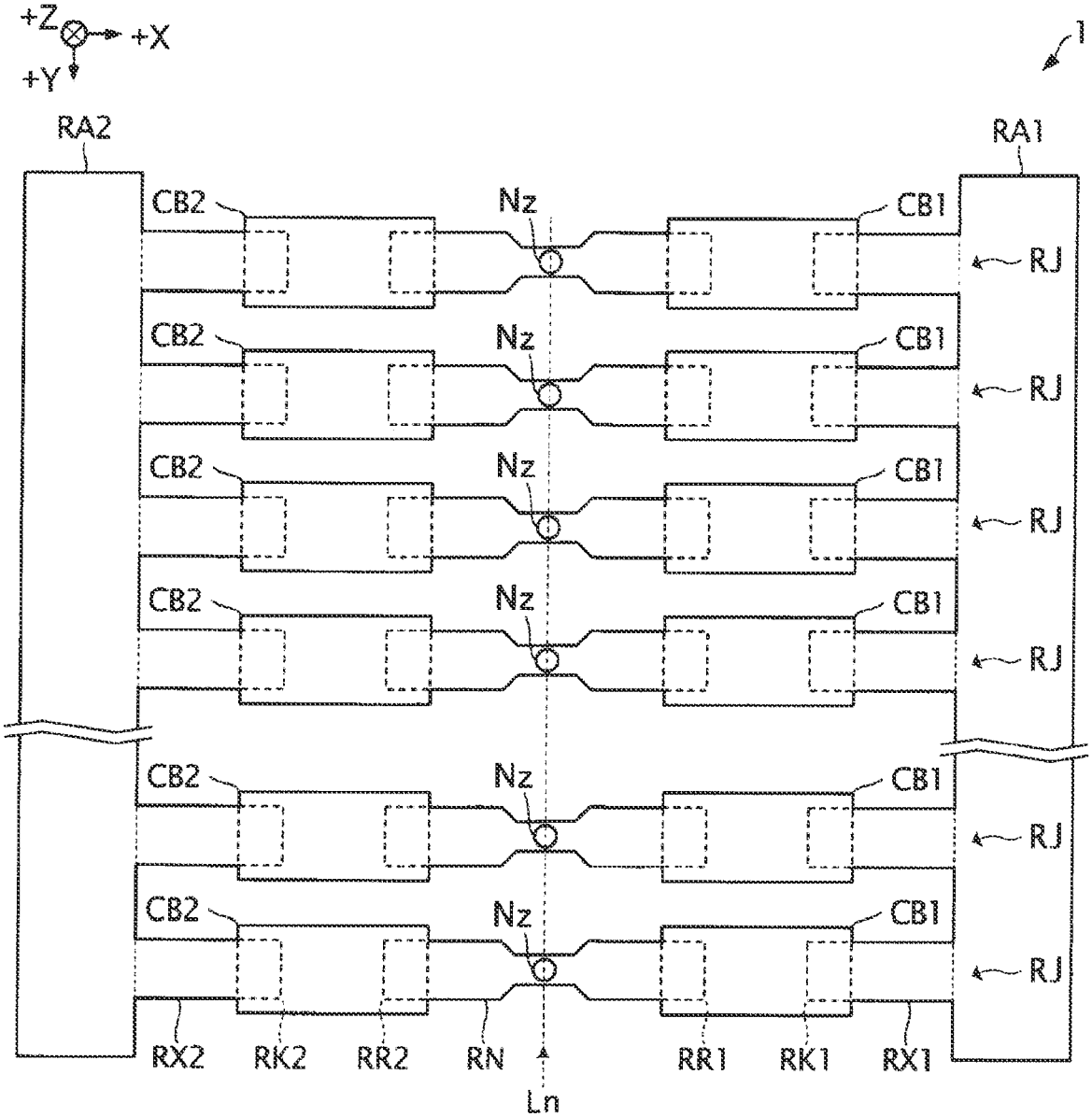
FIG. 4 is a plan view when the liquid discharge head is viewed in a −Z direction.

The liquid discharge head 1 will be described in detail with reference to FIGS. 2 to 5. FIG. 2 is an exploded perspective view of the liquid discharge head 1. FIG. 3 is a cross-sectional view taken along line III-III in FIG. 2. FIG. 4 is a plan view when the liquid discharge head 1 is viewed in the −Z direction. As illustrated in FIG. 2, the liquid discharge head 1 includes a nozzle substrate 60, a communication plate 2, a pressure chamber substrate 3, a diaphragm 4, a storage chamber forming substrate 5, a wiring substrate 8, a compliance sheet 61, and a compliance sheet 62.

As illustrated in FIG. 2, the nozzle substrate 60 is a plate-shaped member elongated along the Y-axis direction. The nozzle substrate 60 is disposed to be substantially parallel to the X-Y plane. For example, the nozzle substrate 60 is manufactured so that a silicon single crystal substrate is processed by using a semiconductor manufacturing technique such as etching. The M-number of nozzles Nz are formed in the nozzle substrate 60. M is a natural number of 1 or more. The nozzle Nz is a through-hole provided in the nozzle substrate 60. In the present embodiment, in the nozzle substrate 60, the M-number of nozzles Nz are aligned to form a nozzle row Ln extending in the Y-axis direction.

As illustrated in FIG. 2, the communication plate 2 is provided on a surface of the nozzle substrate 60 on a side in the −Z direction. The communication plate 2 is a plate-shaped member elongated along the Y-axis direction. The communication plate 2 is disposed to be substantially parallel to the X-Y plane. For example, the communication plate 2 is manufactured so that a silicon single crystal substrate is processed by using a semiconductor manufacturing technique.

As illustrated in FIG. 2, a flow path of the ink is formed in the communication plate 2. Specifically, one common supply flow path RA1 extending in the Y-axis direction and one common discharge flow path RA2 extending in the Y-axis direction are formed in the communication plate 2. As illustrated in FIG. 3, the communication plate 2 further has the M-number of nozzle flow paths RN, the M-number of supply flow paths RR1, the M-number of discharge flow paths RR2, The M-number of communication flow paths RK1, the M-number of communication flow paths RK2, the M-number of communication flow paths RX1, and the M-number of communication flow paths RX2 which respectively correspond to the M-number of nozzles Nz. The communication plate 2 may have one communication flow path RX1 provided in common for M-number of nozzles Nz, or one communication flow path RX2 provided in common for the M-number nozzles Nz.

As illustrated in FIG. 3, the communication flow path RX1 is coupled to the common supply flow path RA1. The communication flow path RX1 is provided to extend along the X-axis direction from the common supply flow path RA1 toward the −X direction. The communication flow path RK1 is coupled to the communication flow path RX1. The communication flow path RK1 is provided to extend along the Z-axis direction from the communication flow path RX1 toward the −Z direction. The communication flow path RK1 is coupled to one end of a pressure chamber CB1 to be described later. A supply flow path RR1 is coupled to the other end of the pressure chamber CB1. The supply flow path RR1 is provided to extend along the Z-axis direction from the pressure chamber CB1 toward the +Z direction. The supply flow path RR1 is coupled to one end of the nozzle flow path RN. One nozzle Nz corresponding to the nozzle flow path RN is provided in the nozzle flow path RN. As illustrated in FIGS. 2 and 3, in the present embodiment, a width of the flow path in the +Z direction is larger and a width in the +Y direction is larger in the vicinity of the nozzle Nz of the nozzle flow path RN, compared to a region other than the vicinity of the nozzle Nz of the nozzle flow path RN. In this manner, a flow velocity of the ink in the vicinity of the nozzle Nz can be raised, and thickening of the ink can be prevented from staying in the vicinity of the nozzle Nz. Accordingly, deterioration of discharge characteristics can be prevented. However, the present embodiment is not limited to this system. For example, the widths of the flow path in the +Z direction may be the same as each other and the widths in the +Y direction may be the same as each other in the vicinity of the nozzle Nz of the nozzle flow path RN and in the region other than the vicinity of the nozzle Nz of the nozzle flow path RN.

The discharge flow path RR2 is coupled to the other end of the nozzle flow path RN. The discharge flow path RR2 is provided to extend along the Z-axis direction from the nozzle flow path RN toward the −Z direction. The discharge flow path RR2 is coupled to one end of the pressure chamber CB2 to be described later. The communication flow path RK2 is coupled to the other end of the pressure chamber CB2. The communication flow path RK2 is provided to extend along the Z-axis direction from the pressure chamber CB2 toward the +Z direction. One end of the communication flow path RX2 is coupled to the communication flow path RK2. The communication flow path RX2 is provided to extend along the X-axis direction from the communication flow path RK2 toward the −X direction. The other end of the communication flow path RX2 is coupled to the common discharge flow path RA2.

As illustrated in FIGS. 2 and 3, the compliance sheet 61 is provided on a surface of the communication plate 2 on a side in the +Z direction to close the common supply flow path RA1, the communication flow path RX1, and the communication flow path RK1. For example, an elastic material is used for the compliance sheet 61. The compliance sheet 61 absorbs pressure fluctuations of the ink inside the common supply flow path RA1, the communication flow path RX1, and the communication flow path RK1. The compliance sheet 62 is provided on a surface of the communication plate 2 on a side in the +Z direction to close the common discharge flow path RA2, the communication flow path RX2, and the communication flow path RK2. For example, the compliance sheet 62 is formed of an elastic material, and absorbs pressure fluctuations of the ink inside the common discharge flow path RA2, the communication flow path RX2, and the communication flow path RK2.

As illustrated in FIGS. 2 and 3, the storage chamber forming substrate 5 is provided on a surface of the communication plate 2 on a side in the −Z direction. The storage chamber forming substrate 5 is a member elongated in the Y-axis direction. For example, the storage chamber forming substrate 5 is formed by injection molding of a resin material. A flow path of the ink is formed inside the storage chamber forming substrate 5. Specifically, one common supply flow path RB1 and one common discharge flow path RB2 are formed in the storage chamber forming substrate 5. The common supply flow path RB1 communicates with the common supply flow path RA1, and the common discharge flow path RB2 communicates with the common discharge flow path RA2.

The storage chamber forming substrate 5 has an introduction port 51 communicating with the common supply flow path RB1 and a discharge port 52 communicating with the common discharge flow path RB2. The ink from the liquid container 93 is supplied to the common supply flow path RB1 via the introduction port 51. In addition, the ink stored in the common discharge flow path RB2 is collected via the discharge port 52.

In the present embodiment, the ink supplied from the liquid container 93 to the introduction port 51 by the circulation mechanism 94 flows into the common supply flow path RA1 after passing through the common supply flow path RB1. A portion of the ink flowing into the common supply flow path RA1 is divided into the communication flow path RX1 and the communication flow path RK1, and flows into each of the pressure chambers CB1. A portion of the ink flowing into the pressure chamber CB1 flows into the pressure chamber CB2 after passing through the supply flow path RR1, the nozzle flow path RN, and the discharge flow path RR2 in this order. A portion of the ink flowing into the pressure chamber CB2 passes through the communication flow path RK2 and the communication flow path RX2 in this order, thereafter, merges with the common discharge flow path RA2, and is discharged from the discharge port 52 after passing through the common discharge flow path RB2. In the following description, the flow path of the ink from the common supply flow path RA1 to the common discharge flow path RA2 will be referred to as a circulation flow path RJ. Specifically, the circulation flow path RJ includes the common supply flow path RA1, the communication flow path RX1, the communication flow path RK1, the pressure chamber CB1, the supply flow path RR1, the nozzle flow path RN, the discharge flow path RR2, the pressure chamber CB2, the communication flow path RK2, the communication flow path RX2, and the common discharge flow path RA2. As illustrated in FIG. 4, the common supply flow path RA1 and the common discharge flow path RA2 are coupled to each other by the M-number of circulation flow paths RJ respectively corresponding to the M-number of nozzles Nz.

As illustrated in FIGS. 2 and 3, an opening 50 is provided in the storage chamber forming substrate 5. The pressure chamber substrate 3, the diaphragm 4, and the wiring substrate 8 are provided inside the opening 50. The pressure chamber substrate 3 is a plate-shaped member elongated in the Y-axis direction. The pressure chamber substrate 3 is provided on a surface of the communication plate 2 on a side in the −Z direction. The pressure chamber substrate 3 is disposed to be substantially parallel to the X-Y plane. For example, the pressure chamber substrate 3 is manufactured so that a silicon single crystal substrate is processed by using a semiconductor manufacturing technique. A flow path of the ink is formed in the pressure chamber substrate 3. Specifically, the pressure chamber substrate 3 has the M-number of pressure chambers CB1 and the M-number of pressure chambers CB2 which respectively correspond to the M-number of nozzles Nz.

The pressure chamber CB1 is provided to extend in the X-axis direction to communicate with the communication flow path RK1 and the supply flow path RR1. The pressure chamber CB2 is provided to extend in the X-axis direction to communicate with the communication flow path RK2 and the discharge flow path RR2. In the following description, when the pressure chamber CB1 and the pressure chamber CB2 are not distinguished from each other, both of these will be referred to as a pressure chamber CBq.

The diaphragm 4 is a plate-shaped member elongated in the Y-axis direction. As illustrated in FIGS. 2 and 3, the diaphragm 4 is provided on a surface of the pressure chamber substrate 3 on a side in the −Z direction. The diaphragm 4 is a member that can be elastically vibrated, and applies a pressure to the liquid inside the pressure chamber CBq. The diaphragm 4 is disposed to be substantially parallel to the X-Y plane. A surface of the diaphragm 4 on a side in the −Z direction is provided with the M-number of piezoelectric elements PZ1 respectively corresponding to the M-number of pressure chambers CB1 and the M-number of piezoelectric elements PZ2 respectively corresponding to the M-number of pressure chambers CB2. In the following description, when the piezoelectric element PZ1 and the piezoelectric element PZ2 are not distinguished from each other, both of these will be referred to as a piezoelectric element PZq. The piezoelectric element PZq is an energy conversion element that converts electric energy of the drive signal Com into kinetic energy. In the present embodiment, the piezoelectric element PZq is a passive element that deforms in response to a change in a potential of the drive signal Com.

The wiring substrate 8 is mounted on a side of the diaphragm 4 in the −Z direction. The wiring substrate 8 is a component for electrically coupling the control device 90 and the liquid discharge head 1 to each other. For example, as the wiring substrate 8, a flexible wiring substrate such as FPC or FFC is used. The drive circuit 81 is mounted on the wiring substrate 8. The drive circuit 81 switches whether or not to supply the drive signal Com to the piezoelectric element PZq, based on the control signal SI.

Figure 5:
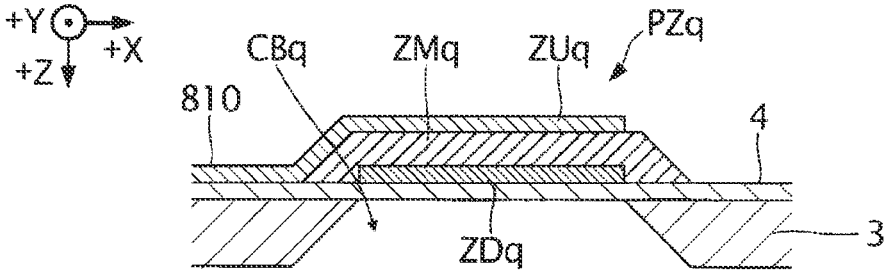
FIG. 5 is an enlarged cross-sectional view illustrating a vicinity of a piezoelectric element.

FIG. 5 is an enlarged cross-sectional view illustrating the vicinity of the piezoelectric element PZq. As illustrated in FIG. 5, the piezoelectric element PZq is a laminated body in which a piezoelectric body ZMq is interposed between a lower electrode ZDq and an upper electrode ZUq. The pressure chamber CBq is provided on a side of the piezoelectric element PZq in the +Z direction. A predetermined reference potential is supplied to the lower electrode ZDq. The drive circuit 81 supplies the drive signal Com to the upper electrode ZUq via a wire 810. The drive signal Com supplied to the piezoelectric element PZ1 will be referred to as a drive signal Com1, and the drive signal Com supplied to the piezoelectric element PZ2 will be referred to as a drive signal Com2. In the present embodiment, when the ink is discharged from the nozzle Nz, a waveform of the drive signal Com1 supplied to the piezoelectric element PZ1 corresponding to the nozzle Nz by the drive circuit 81 and a waveform of the drive signal Com2 supplied to the piezoelectric element PZ2 corresponding to the nozzle Nz by the drive circuit 81 are substantially the same as each other.

The piezoelectric element PZq deforms in response to a change in the potential of the drive signal Com. The diaphragm 4 is vibrated in conjunction with the deformation of the piezoelectric element PZq. The pressure inside the pressure chamber CBq fluctuates due to the vibration of the diaphragm 4. As the pressure inside the pressure chamber CBq fluctuates, the ink filling the inside of the pressure chamber CBq is discharged from the nozzle Nz after passing through the supply flow path RR1, the discharge flow path RR2, and the nozzle flow path RN. Specifically, when the piezoelectric element PZ1 is driven by the drive signal Com1, a portion of the ink filling the inside of the pressure chamber CB1 is discharged from the nozzle Nz after passing through the supply flow path RR1 and the nozzle flow path RN, and. When the piezoelectric element PZ2 is driven by the drive signal Com2, a portion of the ink filling the inside of the pressure chamber CB2 is discharged from the nozzle Nz after passing through the discharge flow path RR2 and the nozzle flow path RN.

The liquid discharge apparatus 100 of the present embodiment circulates the ink from the common supply flow path RA1 to the common discharge flow path RA2 after the ink passes through the circulation flow path RJ. Therefore, even when there exists a period during which the ink inside the pressure chamber CBq is not discharged from the nozzle Nz, it is possible to reduce or prevent a possibility that the ink may stay inside the pressure chamber CBq and in the nozzle flow path RN. Therefore, the liquid discharge apparatus 100 of the present embodiment can reduce or prevent thickening of the ink inside the pressure chamber CBq and the nozzle flow path RN, and can reduce or prevent occurrence of a discharge abnormality in which the ink cannot be discharged from the nozzle Nz.

The liquid discharge apparatus 100 of the present embodiment discharges the ink filling the inside of the pressure chamber CB1 and the ink filling the inside of the pressure chamber CB2 from one nozzle Nz. Therefore, the liquid discharge apparatus 100 of the present embodiment can increase a discharge rate of the ink discharged from the nozzle Nz, for example, compared to an aspect in which only the ink filling the inside of one pressure chamber CBq is discharged from the nozzle Nz.

In the liquid discharge apparatus 100 of the present embodiment, parameters of the ink and setting conditions of the liquid discharge head 1 are further set, based on a simulation result of a particle existence probability in the nozzle Nz. The particle existence probability means a probability that a particle exists per unit volume of the ink. From a viewpoint of properly achieving performance of the ink, it is preferable that the particle existence probability is high. Specifically, the particle existence probability is preferably 60% or higher, and more preferably 80% or higher.

The parameters of the ink include a viscosity of the ink and a particle size of a coloring material contained in the ink. The setting conditions of the liquid discharge head 1 include a circulation flow rate of the ink inside the liquid discharge head 1 and a discharge rate of the ink discharged from the nozzle Nz. For example, the circulation flow rate of the ink means a flow rate of the ink flowing through the flow paths inside the liquid discharge head 1 such as the supply flow path RR1, the nozzle flow path RN, and the discharge flow path RR2. The circulation flow rate of the ink can be adjusted by the circulation mechanism 94. Specifically, an output of the circulation mechanism 94 is increased to increase the circulation flow rate of the ink flowing through the nozzle flow path RN. From a viewpoint of preventing the thickening of the ink, the circulation flow rate is preferably 1E-13 $m^2/s$ or higher, and is more preferably 1E-12 $m^2/s$ or higher. For example, the discharge rate of the ink discharged from the nozzle Nz can be adjusted by changing the potential of the drive signal Com supplied to the piezoelectric element PZq. Specifically, the change in the potential of the drive signal Com supplied to the piezoelectric element PZq is increased to increase the discharge rate of the ink.

A simulation result indicating a correlation between the parameters of the ink and the setting conditions of the liquid discharge apparatus 100 and the particle existence probability in the nozzle Nz will be described with reference to FIGS. 6 to 9. The simulation evaluates a case where the particle existence probability in the nozzle Nz is affected by each factor of the viscosity of the ink and the particle size of the coloring material contained in the ink which serve the parameters of the ink, and the circulation flow rate of the ink and the discharge rate of the ink discharged from the nozzle Nz which serve as the setting conditions of the liquid discharge apparatus 100.

Figure 6:
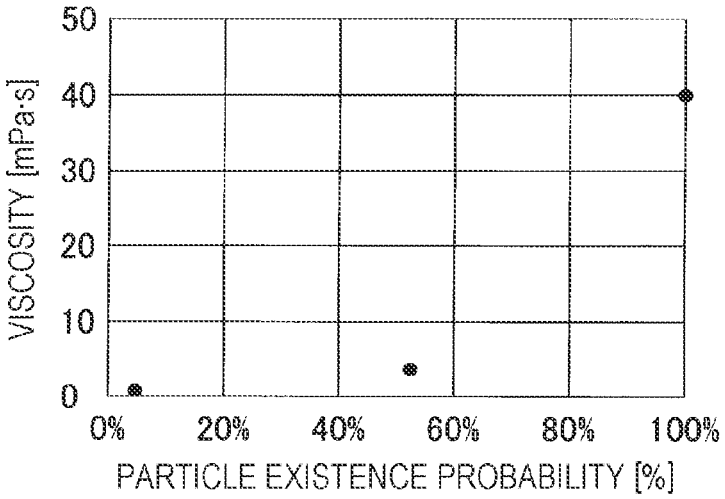
FIG. 6 is a graph illustrating a simulation result obtained by evaluating a correlation between a viscosity of an ink and a particle existence probability of the ink inside a nozzle.

FIG. 6 is a graph illustrating a simulation result obtained by evaluating a correlation between the viscosity of the ink and the particle existence probability of the ink inside the nozzle Nz. A vertical axis in FIG. 6 represents the viscosity of the ink, and a horizontal axis represents the particle existence probability in the nozzle Nz. As the setting conditions of the liquid discharge apparatus 100, the discharge rate is 3E-12 $m^2/s$, and the circulation flow rate is 1.2E-9 $m^2/s$. The particle size of the coloring material contained in the ink is 5 um.

As illustrated in FIG. 6, when the viscosity is 1 mPa·s, the particle existence probability in the nozzle Nz shows 6.3%. When the viscosity is 4 mPa·s, the particle existence probability shows 55.2%. When the viscosity is 40 mPa·s, the particle existence probability shows 100%. In this way, the particle existence probability in the nozzle Nz increases as the viscosity increases. In general, as the viscosity of a liquid decreases, the particle contained in the liquid is easily precipitated. Therefore, the particle contained in the liquid is less likely to be affected by a force of a flow of the liquid. Therefore, the reason that particle existence probability in the nozzle Nz decreases as the viscosity of the ink decreases is considered as follows. Even when the ink having a low viscosity flows through the nozzle flow path RN, the particle is less likely to be affected by the force of the flow of the ink, and the particle is less likely to flow to the nozzle Nz from the nozzle flow path RN.

Figure 7:
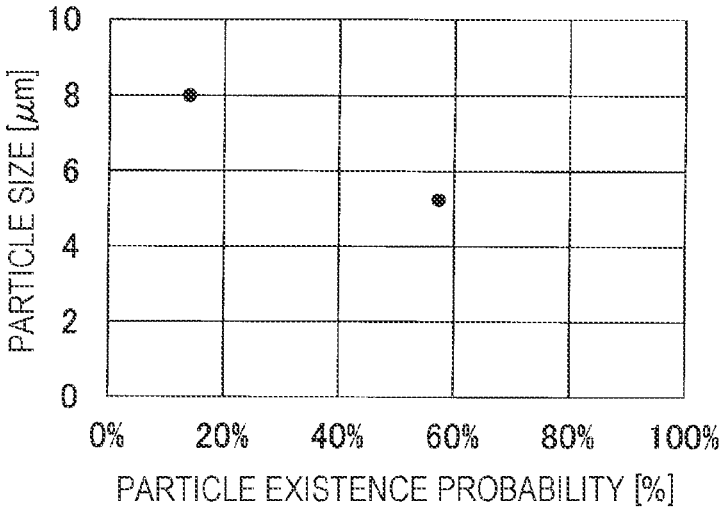
FIG. 7 is a graph illustrating a simulation result obtained by evaluating a correlation between a particle size of a coloring material and the particle existence probability.

FIG. 7 is a graph illustrating a simulation result obtained by evaluating a correlation between the particle size of the particle contained in the ink and the particle existence probability in the nozzle Nz. The vertical axis in FIG. 7 represents the particle size of the coloring material, and the horizontal axis represents the particle existence probability in the nozzle Nz. As the setting conditions of the liquid discharge apparatus 100, the discharge rate is 3E-12 $m^2/s$, and the circulation flow rate is 1.2E-9 $m^2/s$. The viscosity of the ink is set at 4 mPa·s.

As illustrated in FIG. 7, when the particle size is 5 um, the particle existence probability in the simulation is 55.2%. When the particle size is 8 um, the particle existence probability shows 12.6%. In this way, the particle existence probability in the nozzle Nz decreases as the particle size increases. In general, as the particle size of the particle contained in the liquid increases, the particle is likely to be affected by the force of the flow of the liquid. The reason that particle existence probability in the nozzle Nz decreases as the particle size increases is considered as follows. The particle is affected by the flow of the ink flowing to the nozzle Nz from the nozzle flow path RN. Accordingly, the particle is likely to flow to the nozzle Nz.

Figure 8:
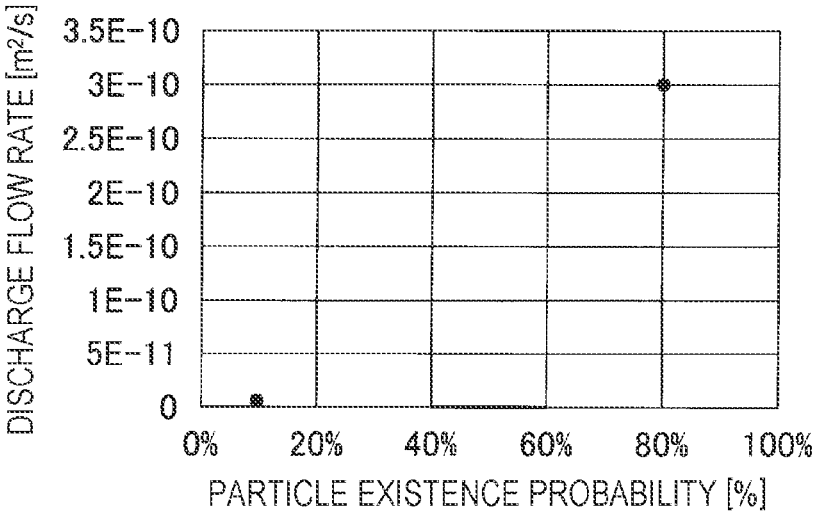
FIG. 8 is a graph illustrating a simulation result obtained by evaluating a correlation between a discharge rate of the ink and the particle existence probability.

FIG. 8 is a graph illustrating a simulation result obtained by evaluating a correlation between the discharge rate of the ink and the particle existence probability in the nozzle Nz. The vertical axis in FIG. 8 represents the discharge rate of the ink discharged from the nozzle Nz, and the horizontal axis represents the particle existence probability in the nozzle Nz. As the setting conditions of the liquid discharge apparatus 100, the circulation flow rate is 1.2E-9 $m^2/s$. The viscosity of the ink is 1 mPa·s, and the particle size of the coloring material contained in the ink is 5 um.

As illustrated in FIG. 8, when the discharge rate of the ink is 3E-12 $m^2/s$, the particle existence probability shows 6.3%. When the discharge rate is 3E-10 $m^2/s$, the particle existence probability shows 93.4%. In this way, the particle existence probability in the nozzle Nz increases as the discharge rate increases. In general, the discharge rate of the ink discharged from the nozzle Nz increases, the amount of the ink supplied to the nozzle Nz increases. The reason that the particle existence probability in the nozzle Nz increases as the discharge rate of the ink increases is as follows. The particle is affected by the ink flowing to the nozzle Nz, and is easily supplied to the nozzle Nz.

Figure 9:
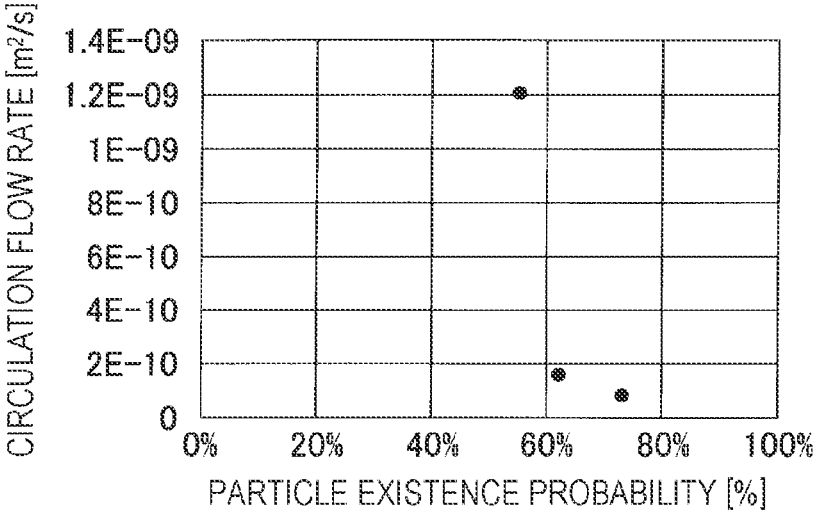
FIG. 9 is a graph illustrating a simulation result obtained by evaluating a correlation between a circulation flow rate and the particle existence probability.

FIG. 9 is a graph illustrating a simulation result obtained by evaluating a correlation between the circulation flow rate and the particle existence probability in the nozzle Nz. The vertical axis in FIG. 9 represents the circulation flow rate of the ink, and the horizontal axis represents the particle existence probability in the nozzle Nz. As the setting conditions of the liquid discharge apparatus 100, the discharge rate is 3E-12 $m^2/s$. The viscosity of the ink is 4 mPa·s, and the particle size of the coloring material contained in the ink is 5 um.

As illustrated in FIG. 9, when the circulation flow rate is 1.2E-9 $m^2/s$, the particle existence probability shows 55.2%. When the circulation flow rate is 1.5E-10 $m^2/s$, the particle existence probability shows 61.9%. When the circulation flow rate is 7.5E-11 $m^2/s$, the particle existence probability shows 72.9%. In this way, the particle existence probability in the nozzle Nz increases as the circulation flow rate decreases. As the circulation flow rate increases, the flow rate of the ink in the nozzle flow path RN increases. When the flow rate of the ink in the nozzle flow path RN increases, the particle is likely to be affected by the force of the flow of the ink in the nozzle flow path RN. Therefore, the reason is considered as follows. The particle is less likely to be supplied to the nozzle Nz from the nozzle flow path RN.

Figure 10:
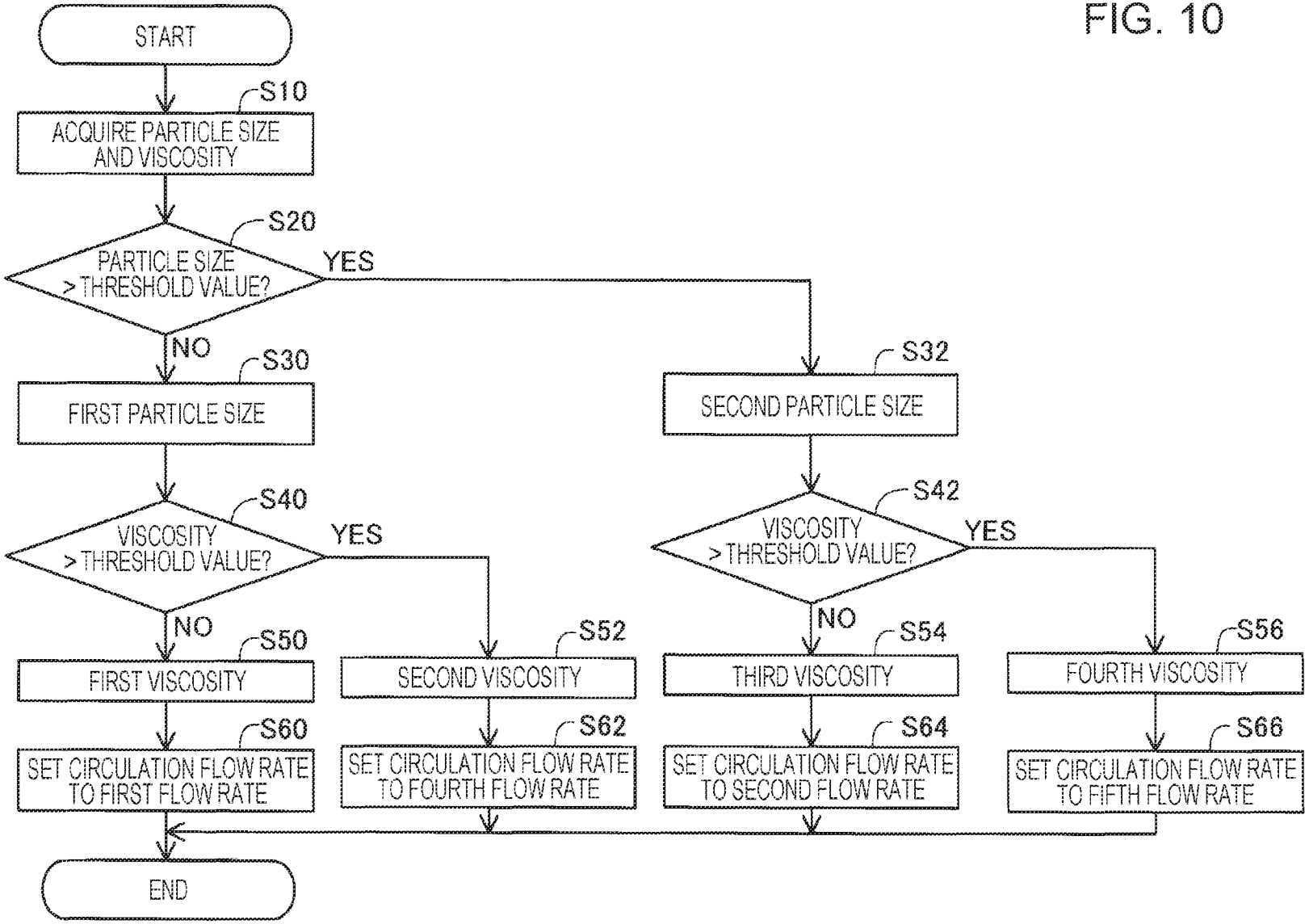
FIG. 10 is a flowchart illustrating a control method for a liquid discharge apparatus which is performed by a control device of the present embodiment.

FIG. 10 is a flowchart illustrating a control method for the liquid discharge apparatus which executed by the control device 90 of the present embodiment. For example, this flow starts when power of the liquid discharge apparatus 100 is turned on. In this flow, the discharge rate is a fixed value, and is set to 3E-12 $m^2/s$. This flow may start when the liquid container 93 is completely replaced. In the liquid discharge apparatus 100 of the present embodiment, from a viewpoint of preventing the thickening of the ink, the circulation flow rate is set to 1E-12 $m^2/s$ or higher. From a viewpoint of preventing deterioration of performance of the ink, the particle existence probability is set to 60% or higher. For this purpose, the above-described simulation results are reflected in the parameters of the ink and the setting conditions of the liquid discharge apparatus 100.

In Step S10, the control device 90 acquires information on an average value of the viscosity and the particle size of the ink. The control device 90 detects a chip which is not illustrated and provided in the liquid container 93, and acquires the parameters of the ink such as the average value of the viscosity and the particle size of the ink inside the liquid container 93. Alternatively, the control device 90 may include a mechanism for measuring the average value of the viscosity and the particle size of the ink inside the liquid discharge apparatus 100. In addition, the liquid discharge apparatus 100 may include an input unit and a display. The control device 90 may acquire the average value of the viscosity and the particle size of the ink, when a user inputs the average value to the input unit in accordance with displaying of the display. In Step S20, it is determined whether or not the acquired average value of the particle size is greater than a predetermined threshold value. In the present embodiment, the predetermined threshold value in Step S20 is set to 6 um. When the acquired average value of the particle size is 6 um or smaller (S20: NO), the process proceeds to Step S30, and the control device 90 determines the particle size of the ink as a first particle size.

In Step S40, the control device 90 compares the acquired viscosity of the ink with the predetermined threshold value. In the present embodiment, the predetermined threshold value in Step S40 is set to 3 mPa·s. When the viscosity of the ink is 3 mPa·s or lower (S40: NO), the process proceeds to Step S50, and the control device 90 determines the viscosity of the ink as a first viscosity. The ink whose particle size of the contained particle is the first particle size and whose viscosity is the first viscosity will be referred to as the first liquid.

In Step S60, the control device 90 controls an operation of the circulation mechanism 94 so that the circulation flow rate of the first liquid is a first flow rate. The first flow rate means a discharge rate included in a range from 1E-12 $m^2/s$ to 1E-11 $m^2/s$. In the present embodiment, the first flow rate is set to 6.40E-11 $m^2/s$. The circulation flow rate may have an error of −20% to +20% with respect to a set value. From a viewpoint of preventing variations in the particle existence probability, it is preferable the circulation flow rate falls within an error of −10% to +10% with respect to the set value. The control device 90 completes this flow when the circulation flow rate is set to the first flow rate.

In Step S40, when the viscosity of the ink is higher than 3 mPa·s (S40: YES), the process proceeds to Step S52, and the control device 90 determines the viscosity of the ink as a second viscosity higher than the first viscosity. The ink whose average particle size of the contained particle is the first particle size and whose viscosity is the second viscosity will be referred to as a fourth liquid.

In Step S62, in order that the particle existence probability is 60% higher in the fourth liquid having the second viscosity higher than the first viscosity of the first liquid, the control device 90 controls an operation of the circulation mechanism 94 so that the circulation flow rate of the fourth liquid is a fourth flow rate higher than the first flow rate of the first liquid. In the present embodiment, the fourth flow rate is 1.50E-10 $m^2/s$. The control device 90 completes this flow when the circulation flow rate is set to the fourth flow rate.

In Step S20, when the acquired average value of the particle size is greater than 6 um (S20: YES), the process proceeds to Step S32, and the control device 90 determines the particle size of the ink as a second particle size larger than the first particle size. In Step S42, the control device 90 compares the acquired viscosity of the ink with a predetermined threshold value. In the present embodiment, the predetermined threshold value in Step S42 is set to 3 mPa·s as in Step S40. The threshold value in Step S42 may be set to a value different from that in Step S40.

When the viscosity of the ink is 3 mPa·s or lower (S42: NO), the process proceeds to Step S54, and the control device 90 determines the viscosity of the ink as a third viscosity. The third viscosity may be lower than the fourth viscosity, and may be equal to the first viscosity, for example. The ink whose average particle size of the contained particle is the second particle size and whose viscosity is the third viscosity will be referred to as the second liquid.

In Step S64, the control device 90 sets the circulation flow rate of the second liquid to a second flow rate. In the present embodiment, the second flow rate is 1.80E-11 $m^2/s$. The second liquid has the second particle size larger than the first particle size of the particle contained in the first liquid. Accordingly, in order that the particle existence probability is 60% or higher, the second flow rate is set to the circulation flow rate lower than the first flow rate. In the liquid discharge apparatus 100 of the present embodiment, when the second liquid is supplied at the first flow rate, the particle existence probability in the nozzle Nz is lower than 60%. The control device 90 completes this flow when the circulation flow rate of the second liquid is set.

In Step S42, when the viscosity of the ink is higher than 3 mPa·s (S42: YES), the process proceeds to Step S56, and the control device 90 determines the viscosity of the ink as a fourth viscosity higher than the third viscosity. The fourth viscosity may be higher than the third viscosity, and may be equal to the second viscosity, for example. The ink whose average particle size of the contained particle is the second particle size and whose viscosity is the fourth viscosity will be referred to as a fifth liquid.

In Step S66, the control device 90 sets the circulation flow rate of the fifth liquid to a fifth flow rate. In the present embodiment, the fifth flow rate is 7.70E-11 $m^2/s$. The fifth liquid has the fourth viscosity higher than the third viscosity of the second liquid. Accordingly, in order that the particle existence probability is 60% or higher, the fifth flow rate is set to the fifth flow rate higher than the second flow rate of the second liquid. The control device 90 completes this flow when the circulation flow rate of the fifth liquid is set.

As described above, according to the liquid discharge apparatus 100 of the present embodiment, when the second liquid containing the particle having the second particle size larger than the first particle size of the particle contained in the first liquid is supplied, the control device 90 controls the circulation mechanism 94 so that the circulation flow rate is the second flow rate lower than the first flow rate. According to the liquid discharge apparatus 100 of the present embodiment, the particle existence probability in the nozzle Nz which may deteriorate due to an increase in the particle size can be compensated by decreasing the circulation flow rate. Therefore, even when the inks having different particle sizes are supplied to the liquid discharge head 1, the inks are adjusted to have the circulation flow rate corresponding to the particle size of the particle contained in the ink. In this manner, while the thickening of the ink can be prevented, it is possible to reduce or prevent occurrence of a disadvantage that the performance of the ink deteriorates due to a decrease in the particle existence probability.

According to the liquid discharge apparatus 100 of the present embodiment, when the fifth liquid containing the particles whose average value of the particle size is the second particle size, and having the fourth viscosity higher than the third viscosity of the second liquid is supplied to the liquid discharge head 1, the control device 90 controls the circulation mechanism 94 so that the circulation flow rate is the fifth flow rate higher than the second flow rate. The liquid discharge apparatus 100 of the present embodiment can obtain a surplus for increasing the circulation flow rate by the amount corresponding to the particle existence probability that can increase in response to an increase in the viscosity. Therefore, when the ink having a high viscosity is supplied, while occurrence of a disadvantage that the performance of the ink deteriorates due to a decrease in the particle existence probability, the thickening of the ink can be further decreased by further increasing the circulation flow rate.

According to the liquid discharge apparatus 100 of the present embodiment, when the fourth liquid containing the particles whose average value of the particle size is the first particle size, and having the second viscosity higher than the first viscosity of the first liquid is supplied to the liquid discharge head 1, the control device 90 controls the circulation mechanism 94 so that the circulation flow rate is the fourth flow rate higher than the first flow rate. In the liquid discharge apparatus 100 of the present embodiment, the particle existence probability in the nozzle Nz can be further increased by decreasing the particle size and increasing the viscosity. Therefore, it is possible to obtain a surplus for increasing the circulation flow rate by the amount corresponding to the particle existence probability that can increase in response to a decrease in the particle size and an increase in the viscosity. Therefore, when the ink having a small particle size and a high viscosity is supplied, while the thickening can be further prevented by circulating the ink, deterioration of performance of the ink can be prevented.

According to the liquid discharge apparatus 100 of the present embodiment, all of a plurality of types of liquids including the first liquid and the second liquid which are stored in the liquid container 93 can be supplied to one liquid discharge head 1. Therefore, according to the liquid discharge apparatus 100 of the present embodiment, even when the plurality of types of inks are supplied, while the thickening of the ink can be prevented in accordance with the type of the ink, deterioration of the performance of the ink can be prevented.

According to the liquid discharge apparatus 100 of the present embodiment, when the first liquid is supplied to the liquid discharge head at the first flow rate, the particle existence probability in the nozzle Nz is 60% or higher. When the second liquid is supplied to the liquid discharge head at the second flow rate, the particle existence probability in the nozzle Nz is 60% or higher. Therefore, the liquid discharge apparatus 100 of the present embodiment can reduce or prevent deterioration of the performance of the first liquid and the second liquid as the ink.

B. Other Embodiments

B1. FIG. 11 is a view for describing parameter settings of the liquid discharge apparatus 100 according to Other Embodiment 1. A viscosity VC is 1 mPa·s, and a discharge rate VA is 3E-12 $m^2/s$. In FIG. 11, a set value of the circulation flow rate which is required for setting the particle existence probability in the nozzle Nz to 60% or higher is illustrated for each particle size PS of the particle contained in the ink. As illustrated in FIG. 11, in the liquid discharge apparatus 100 of the present embodiment, the circulation flow rate is set to decrease as the particle size PS of the supplied ink increases. In this manner, even when the ink having the different particle size PS is supplied, the circulation mechanism 94 can be controlled so that the circulation flow rates respectively correspond to the particle sizes PS, and the particle existence probability in the nozzle Nz can be set to 60% or higher. The circulation flow rate illustrated in FIGS. 11 to 16 is not limited to values illustrated in the drawings, and may fall within a range of −20% to +20% with respect to the illustrated values. From a viewpoint of preventing variations in the particle existence probability in the nozzle Nz, the circulation flow rate is preferably lower than the circulation flow rate within the range of −10% to +10%.

In the above-described first embodiment, an example has been described as follows. For example, the first flow rate as the circulation flow rate when the liquid has the first particle size is 6.40E-11 $m^2/s$, and for example, the second flow rate as the circulation flow rate when the liquid has the second particle size larger than the first particle size is 1.80E-11 $m^2/s$. On the other hand, as illustrated in FIG. 11, when the third liquid containing the particles whose average value of the particle size PS is the third particle size larger than the second particle size is supplied to the liquid discharge head 1, the control device 90 may further control the circulation mechanism 94 so that the circulation flow rate of the third liquid is the third flow rate lower than the second flow rate. For example, the third particle size is 13 um. For example, the third flow rate is 7.30E-12 $m^2/s$.

In the liquid discharge apparatus 100 of this aspect, even when the plurality of types of liquids having the different particle sizes PS such as three or more types of particle sizes are supplied to the liquid discharge head 1, the liquids can be adjusted to have the circulation flow rates respectively corresponding to the liquids. Therefore, even when the inks having three or more different types of particle sizes are supplied, while the thickening can be prevented by circulating the ink, deterioration of the performance of the ink can be prevented.

B2. In the above-described first embodiment, an example has been described as follows. After the particle size is confirmed in Step S20, the viscosity of the ink is confirmed in Step S40 or Step S42. That is, an aspect for confirming the parameters of the liquid in the order of the particle size and the viscosity has been described. In contrast, the liquid discharge apparatus 100 may confirm the particle size after confirming the viscosity.

FIG. 12 is a view for describing parameter settings of the liquid discharge apparatus 100 according to Other Embodiment 2. The particle size PS is 5 um, and the discharge rate VA is 3E-12 $m^2/s$. In FIG. 12, a set value of the circulation flow rate which required for setting the particle existence probability in the nozzle Nz to 60% or higher is illustrated for each ink viscosity VC. As illustrated in FIG. 12, in the liquid discharge apparatus 100 of the present embodiment, the circulation flow rate is set to increase as the viscosity VC of the supplied ink increases. In this manner, even when the inks having different viscosities VC are supplied, the circulation mechanism 94 can be controlled so that the circulation flow rates respectively correspond to the viscosities VC, and the particle existence probability in the nozzle Nz can be set to 60% or higher.

In the liquid discharge apparatus 100 of the present embodiment, when the ink having the first viscosity is supplied to the liquid discharge head 1, the control device 90 controls the circulation mechanism 94 so that the circulation flow rate is the first flow rate. Specifically, for example, the first viscosity is 1 mPa·s, and for example, the first flow rate is 6.40E-11. Furthermore, when the fourth liquid having the second viscosity higher than the first viscosity is supplied to the liquid discharge head 1, the control device 90 controls the circulation mechanism 94 so that the circulation flow rate is the fourth flow rate higher than the first flow rate. The second viscosity is 4 mPa·s, and the fourth flow rate is 1.50E-10.

According to the liquid discharge apparatus 100 of this aspect, for example, even when the plurality of types of liquids having the different viscosities are supplied, the liquids can be adjusted to have the circulation flow rates respectively corresponding to the viscosities. Therefore, even when the inks having the different viscosities are supplied, while the thickening of the ink can be prevented, deterioration of the performance of the ink can be prevented. In the liquid discharge apparatus 100 of the present embodiment, the circulation flow rate is increased by the amount corresponding to the particle existence probability that can increase in response to an increase in the viscosity. Therefore, when the ink having the high viscosity is supplied, while the thickening of the ink can be further prevented, deterioration of the performance of the ink can be prevented.

In the liquid discharge apparatus 100 of the present embodiment, when the sixth liquid having the fifth viscosity higher than the second viscosity is supplied to the liquid discharge head 1, the control device 90 further controls the circulation mechanism 94 so that the circulation flow rate of the sixth liquid is the eighth flow rate higher than the fourth flow rate. For example, the fifth viscosity is 40 mPa·s, and the eighth flow rate is 9.80E-9 $m^2/s$.

According to the liquid discharge apparatus 100 of this aspect, the liquids can be adjusted to have the circulation flow rates respectively corresponding to the plurality of types of liquids having the different viscosities VC such as three or more types of viscosities. Therefore, even when the inks having three or more different types of viscosities are supplied to the liquid discharge head 1, while the thickening can be prevented by circulating the ink, deterioration of the performance of the ink can be prevented.

B3. FIG. 13 is a view for describing parameter settings of the liquid discharge apparatus 100 according to Other Embodiment 3. The particle size PS is 8 um, and the discharge rate VA is 3E-12 $m^2/s$. In FIG. 13, a set value of the circulation flow rate which is required for setting the particle existence probability in the nozzle Nz to 60% or higher is illustrated for each ink viscosity VC. In the above-described first embodiment, an example has been described as follows. When the average particle size is the second particle size, in a case where the viscosity VC is 3 mPa·s or lower which is the predetermined threshold value, the control device 90 sets the circulation flow rate to the second flow rate. When the viscosity VC is higher than 3 mPa·s, the control device 90 controls the circulation mechanism 94 so that the circulation flow rate is the fifth flow rate higher than the second flow rate. In contrast, as illustrated in FIG. 13, for example, when the viscosity VC of the supplied ink is higher than 3 mPa·s and 10 mPa·s or lower, the circulation flow rate may be controlled to be the fifth flow rate. Furthermore, when the ink having the viscosity VC higher than 10 mPa·s is supplied, the circulation flow rate corresponding to each range of the respective viscosities VC, for example, such as 10 to 20 mPa·s and 20 to 30 mPa·s may be set.

B4. In the above-described first embodiment, an example has been described in which the discharge rate is a fixed value of 3E-12 $m^2/s$. In contrast, the liquid discharge apparatus 100 may adjust the circulation flow rate in accordance with the discharge rate.

FIG. 14 is a view for describing parameter settings of the liquid discharge apparatus 100 according to Other Embodiment 4. The particle size PS is 5 um, and the viscosity VC is 1 mPa·s. In FIG. 14, a set value of the circulation flow rate which is required for setting the particle existence probability in the nozzle Nz to 60% or higher is illustrated for each discharge rate of the ink VA discharged from the nozzle Nz. Specifically, the circulation flow rate is set to increase as the discharge rate VA from the nozzle Nz increases. In this manner, even when the discharge rate VA from the nozzle Nz is changed to a plurality of types, the circulation mechanism 94 can be controlled so that the circulation flow rates respectively correspond to the discharge rates VA, and the particle existence probability in the nozzle Nz can be set to 60% or higher.

The control device 90 may confirm the discharge rate VA per unit time of the first liquid after confirming the particle size PS in Step S20 illustrated in FIG. 10. When the discharge rate VA is the first discharge rate, the circulation mechanism 94 may be controlled so that the circulation flow rate of the first liquid is the first flow rate. Specifically, the first discharge rate is 3E-12 $m^2/s$, and the first flow rate is 6.40E-11 $m^2/s$. In addition, after the particle size PS is confirmed in Step S20, the discharge rate VA of the second liquid may be set to the second discharge rate higher than the first discharge rate. In this case, the circulation mechanism 94 may be controlled so that the circulation flow rate of the second liquid is the sixth flow rate higher than the first flow rate. Specifically, the second discharge rate is 3E-10 $m^2/s$, and the sixth flow rate is 1.20E-9 $m^2/s$.

According to the liquid discharge apparatus 100 of this aspect, the circulation flow rate can be increased to further prevent the thickening of the ink, and the particle existence probability that can decrease in response to an increase in the circulation flow rate can be compensated by increasing the discharge rate VA. Therefore, while deterioration of the performance of the ink can be prevented by preventing a decrease in the particle existence probability of the nozzle Nz, it is possible to more reliably reduce or prevent occurrence of the thickening of the ink by increasing a circulation amount.

After the viscosity VC is confirmed in Step S20 illustrated in FIG. 10, the control device 90 may confirm a magnitude of the discharge rate VA per unit time of the ink. For example, after Step S20 is performed, when the discharge rate VA of the ink is set to the first discharge rate, the control device 90 may control the circulation mechanism 94 so that the circulation flow rate is the first flow rate. When the discharge rate VA is set to the second discharge rate higher than the first discharge rate, the control device 90 may control the circulation mechanism 94 so that the circulation flow rate is the sixth flow rate higher than the first flow rate. Specifically, the second discharge rate is 3E-10 $m^2/s$, and the sixth flow rate is 1.20E-9 $m^2/s$. According to the liquid discharge apparatus 100 of this aspect, the circulation flow rate is increased by the amount corresponding to the particle existence probability that increases as the discharge rate increases. In this manner, while deterioration of the performance of the first liquid can be prevented, it is possible to more reliably reduce or prevent occurrence of the thickening of the first liquid by increasing the circulation amount.

FIG. 15 is a second view for describing parameter settings of the liquid discharge apparatus 100 according to Other Embodiment 4. The particle size PS is 8 um, and the viscosity VC is 1 mPa·s. In FIG. 15, a set value of the circulation flow rate which is required for setting the particle existence probability in the nozzle Nz to 60% or higher is illustrated for each discharge rate VA. Specifically, the circulation flow rate is set to increase as the discharge rate VA increases. The liquid discharge apparatus 100 may control the circulation mechanism 94 so that the circulation flow rate corresponds to the discharge rate VA.

After Step S20 is performed, the control device 90 may determine in Step S42 whether or not the discharge rate is greater than a predetermined threshold value. For example, in Step S42, when the discharge rate VA of the second liquid is set to the third discharge rate, the circulation mechanism 94 is controlled so that the circulation flow rate is the second flow rate. In addition, when the discharge rate VA of the second liquid is set to the fourth discharge rate higher than the third discharge rate, the circulation mechanism 94 may be controlled so that the circulation flow rate is the seventh flow rate higher than the second flow rate. Specifically, the third discharge rate is 3E-12, and the fourth discharge rate is 3E-10. The third discharge rate is equal to the first discharge rate described above, and the fourth discharge rate is equal to the second discharge rate described above. However, the fourth discharge rate may be set to any desired discharge rate other than the first discharge rate or the second discharge rate.

According to the liquid discharge apparatus 100 of this aspect, the circulation flow rate of the second liquid is increased to prevent the thickening of the second liquid, and the particle existence probability that decreases in response to an increase in the circulation flow rate is compensated by increasing the discharge rate VA. Therefore, while deterioration of the performance of the second liquid can be prevented, it is possible to more reliably reduce or prevent occurrence of the thickening of the second liquid.

B5. In the above-described first embodiment, the following aspect has been described as an example. After the particle size is confirmed in Step S20, the viscosity of the ink is confirmed in Step S40 or Step S42. That is, the parameters of the liquid are confirmed in the order of the particle size and the viscosity. In contrast, the liquid discharge apparatus 100 may set the circulation flow rate after the viscosity and the discharge rate are confirmed in this order. The liquid discharge apparatus 100 may control the circulation mechanism 94 so that the fourth liquid having the viscosity different from that of the first liquid also has the circulation flow rate corresponding to the discharge rate VA in which the particle existence probability is 60% or higher.

FIG. 16 is a view for describing parameter settings of the liquid discharge apparatus 100 according to Other Embodiment 5. The particle size PS is 5 um, and the viscosity VC is 4 mPa·s. In FIG. 16, a set value of the circulation flow rate which is required for setting the particle existence probability in the nozzle Nz to 60% or higher is illustrated for each discharge rate VA. Specifically, the circulation flow rate is set to increase as the discharge rate VA increases. The liquid discharge apparatus 100 may control the circulation mechanism 94 so that the circulation flow rate corresponds to the discharge rate VA.

In the liquid discharge apparatus 100 of the present embodiment, when the fourth liquid having the second viscosity which is the viscosity VC higher than the first viscosity is supplied to the liquid discharge head 1, in a case where the discharge rate VA of the fourth liquid is set to the fifth discharge rate, the circulation mechanism 94 is controlled so that the circulation flow rate of the fourth liquid is the fourth flow rate. When the discharge rate VA of the fourth liquid is set to the sixth discharge rate higher than the fifth discharge rate, the circulation mechanism 94 is controlled so that the circulation flow rate of the fourth liquid is a ninth flow rate higher than the fourth flow rate. Specifically, the fourth flow rate is 1.50E-10 $m^2/s$, and the ninth flow rate is 5.60E-9 $m^2/s$. The fifth discharge rate is 3E-12, and the sixth discharge rate is 3E-10. The fifth discharge rate is equal to the first discharge rate described above, and the sixth discharge rate is equal to the second discharge rate described above. However, the sixth discharge rate may be set to any desired discharge rate other than the first discharge rate or the second discharge rate.

According to the liquid discharge apparatus 100 of this aspect, when the discharge rate increases in the fourth liquid having the second viscosity higher than the first viscosity, the control device 90 controls the circulation mechanism 94 so that the circulation flow rate increase. The particle existence probability that can decrease in response to an increase in the circulation flow rate can be compensated by increasing the discharge rate VA. Therefore, while deterioration of the performance of the fourth liquid can be prevented, it is possible to more reliably reduce or prevent the occurrence of thickening by increasing the circulation amount of the fourth liquid.

B6. In the above-described first embodiment, one pressure chamber CB1 communicating with one nozzle Nz and the nozzle flow path RN via the supply flow path RR1, one piezoelectric element PZ1 corresponding to the pressure chamber CB1, one pressure chamber CB2 communicating via the discharge flow path RR2, and one piezoelectric element PZ2 corresponding to the pressure chamber CB2 are provided. In contrast, four pressure chambers may be provided for one nozzle Nz and the nozzle flow path RN, and four piezoelectric elements corresponding to each of the pressure chambers may be provided. For example, two pressure chambers CB1 communicating with one nozzle Nz and the nozzle flow path RN via two supply flow paths RR1, two piezoelectric elements PZ1 respectively corresponding to the pressure chambers CB1, two pressure chambers CB2 communicating with the nozzle flow path RN via two discharge flow paths RR2, and two piezoelectric elements PZ2 respectively corresponding to the pressure chambers CB2 may be provided.

B7. In the above-described first embodiment, an example has been described as follows. In the circulation mechanism 94, the plurality of types of liquids stored in the liquid container 93 are supplied to one liquid discharge head 1. In contrast, for example, the liquid discharge apparatus 100 may include a plurality of liquid discharge heads including a first liquid discharge head having the configuration the same as that of the liquid discharge head 1 described above in the first embodiment, and a second liquid discharge head having the configuration the same as that of the liquid discharge head 1. In this case, for example, the circulation mechanism 94 may supply the first liquid to the first liquid discharge head, and may supply the second liquid to the second liquid discharge head. According to the liquid discharge apparatus 100 of this aspect, different liquid discharge heads can be used for each type of the inks. Accordingly, compared to an aspect in which the plurality of types of liquids are supplied to one liquid discharge head, conditions of the circulation flow rates and the discharge rates are easily switched for each type of the inks.

C. Other Aspects

The present disclosure is not limited to the above-described embodiment, and can be realized in various aspects within the scope not departing from the concept of the present disclosure. For example, the present disclosure can also be realized in the following aspects. In order to partially or entirely solve the problems of the present disclosure, or in order to partially or entirely achieve advantageous effects of the present disclosure, technical features in the above-described embodiments corresponding to technical features in each aspect described below can be replaced or combined with each other as appropriate. In addition, when the technical features are not described herein as essential elements, the technical features can be deleted as appropriate.

1. According to an aspect of the present disclosure, there is provided a liquid discharge apparatus including a liquid discharge head that discharges a liquid containing particle, a circulation mechanism that adjusts a flow rate of the liquid circulated in the liquid discharge head, and a control device that controls an operation of the circulation mechanism. In the liquid discharge apparatus, the liquid discharge head includes a pressure chamber for applying a pressure to the liquid, a supply flow path communicating with the pressure chamber, a nozzle flow path communicating with the supply flow path, a nozzle provided in the nozzle flow path to discharge the liquid by the pressure applied in the pressure chamber, and a discharge flow path coupled to an opposite side via the nozzle in the nozzle flow path. When a first liquid containing the particles whose particle size average value is a first particle size is supplied to the liquid discharge head, the control device controls the circulation mechanism so that a circulation flow rate of the first liquid in the supply flow path, the nozzle flow path, and the discharge flow path is a first flow rate. When a second liquid containing the particles whose particle size average value is a second particle size larger than the first particle size is supplied to the liquid discharge head, the control device controls the circulation mechanism so that the circulation flow rate of the second liquid is a second flow rate lower than the first flow rate. According to the liquid discharge apparatus of this aspect, the particle existence probability that can decrease in response to an increase in the particle size can be compensated by decreasing the circulation flow rate. Therefore, even when the inks having the different particle sizes are supplied to the liquid discharge head, the inks are adjusted to have the circulation flow rate of the ink which corresponds to the particle size. In this manner, while the thickening of the ink can be prevented, deterioration of the performance of the ink can be prevented.
2. In the liquid discharge apparatus of the above-described aspect, when a third liquid containing the particles whose particle size average value is a third particle size larger than the second particle size is supplied to the liquid discharge head, the control device may further control the circulation mechanism so that the circulation flow rate of the third liquid is a third flow rate lower than the second flow rate. According to the liquid discharge apparatus of this aspect, even when the liquids having three different types of the particle sizes are supplied, while the thickening can be prevented by circulating the liquid, deterioration of the performance of the liquid can be prevented.
3. In the liquid discharge apparatus of the above-described aspect, when a fourth liquid containing the particles whose particle size average value is the first particle size and having a second viscosity higher than a first viscosity of the first liquid is supplied to the liquid discharge head, the control device may further control the circulation mechanism so that the circulation flow rate is a fourth flow rate higher than the first flow rate. According to the liquid discharge apparatus of this aspect, when the liquid having a small particle size and a high viscosity is supplied, while the thickening can be further prevented by circulating the liquid, deterioration of the performance of the liquid can be prevented.
4. In the liquid discharge apparatus of the above-described aspect, when a fifth liquid containing the particles whose particle size average value is the second particle size and having a fourth viscosity higher than a third viscosity which is a viscosity of the second liquid is supplied to the liquid discharge head, the control device may further control the circulation mechanism so that the circulation flow rate is a fifth flow rate higher than the second flow rate. According to the liquid discharge apparatus of this aspect, when the liquid having the high viscosity is supplied, while occurrence of a disadvantage that the performance of the ink deteriorates due to a decrease in the particle existence probability, the thickening of the ink can be further decreased by further increasing the circulation flow rate.
5. In the liquid discharge apparatus of the above-described aspect, when a discharge rate per unit time of the first liquid is set to a first discharge rate, the control device may control the circulation mechanism so that the circulation flow rate of the first liquid is the first flow rate. When the discharge rate of the second liquid is set to a second discharge rate higher than the first discharge rate, the control device may control the circulation mechanism so that the circulation flow rate of the second liquid is a sixth flow rate higher than the first flow rate. According to the liquid discharge apparatus of this aspect, while deterioration of the performance of the liquid can be prevented by preventing a decrease in the particle existence probability, it is possible to more reliably reduce or prevent occurrence of the thickening of the liquid by increasing the circulation amount.

6. In the liquid discharge apparatus of the above-described aspect, when a discharge rate per unit time of the second liquid is set to a third discharge rate, the control device may control the circulation mechanism so that the circulation flow rate of the second liquid is the second flow rate. When the discharge rate of the second liquid is set to a fourth discharge rate higher than the third discharge rate, the control device may control the circulation mechanism so that the circulation flow rate is a seventh flow rate higher than the second flow rate. According to the liquid discharge apparatus of this aspect, while deterioration of the performance of the second liquid can be prevented, it is possible to more reliably reduce or prevent occurrence of the thickening of the second liquid.

7. In the liquid discharge apparatus of the above-described aspect, both the first liquid and the second liquid may be supplied to one of the liquid discharge heads. According to the liquid discharge apparatus of this aspect, even when the plurality of types of liquids are supplied, while the thickening of the liquid can be prevented in accordance with the type of the supplied liquid, deterioration of the performance of the liquid can be prevented.

8. The liquid discharge apparatus of the above-described aspect may further include a plurality of the liquid discharge heads including a first liquid discharge head to which the first liquid is supplied, and a second liquid discharge head to which the second liquid is supplied, the second liquid discharge head being different from the first liquid discharge head. According to the liquid discharge apparatus of this aspect, the different liquid discharge head can be used for each type of the liquids. Accordingly, compared to an aspect in which the plurality of types of liquids are supplied to one liquid discharge head, conditions of the circulation flow rates and the discharge rates are easily switched for each type of the liquids.

9. In the liquid discharge apparatus of the above-described aspect, when a probability that the particle exists per unit volume of the liquid is defined as a particle existence probability, in a case where the first liquid is supplied to the liquid discharge head at the first flow rate, the particle existence probability of the first liquid in the nozzle may be 60% or higher. When the second liquid is supplied to the liquid discharge head at the second flow rate, the particle existence probability of the second liquid in the nozzle may be 60% or higher. According to the liquid discharge apparatus of this aspect, it is possible to reduce or prevent deterioration of the performance of the first liquid and the second liquid.

10. In the liquid discharge apparatus of the above-described aspect, when the second liquid is supplied to the liquid discharge head at the first flow rate, the particle existence probability of the second liquid in the nozzle may be lower than 60%. According to the liquid discharge apparatus of this aspect, it is possible to reduce or prevent deterioration of the performance of the second liquid.

11. According to another aspect of the present disclosure, there is provided a liquid discharge apparatus including a liquid discharge head that discharges a liquid containing a particle, a circulation mechanism that adjusts a flow rate of the liquid circulated in the liquid discharge head, and a control device that controls an operation of the circulation mechanism. In the liquid discharge apparatus, the liquid discharge head includes a pressure chamber for applying a pressure to the liquid, a supply flow path communicating with the pressure chamber, a nozzle flow path communicating with the supply flow path, a nozzle provided in the nozzle flow path to discharge the liquid by the pressure applied in the pressure chamber, and a discharge flow path coupled to an opposite side via the nozzle in the nozzle flow path. When a first liquid having a first viscosity is supplied to the liquid discharge head, the control device controls the circulation mechanism so that a circulation flow rate of the first liquid in the nozzle flow path is a first flow rate. When a fourth liquid having a second viscosity which is a viscosity higher than the first viscosity is supplied to the liquid discharge head, the control device controls the circulation mechanism so that the circulation flow rate is a fourth flow rate higher than the first flow rate. According to the liquid discharge apparatus of this aspect, when the liquid having the high viscosity is supplied, while the thickening of the liquid can be further prevented, deterioration of the performance of the liquid can be prevented.

12. In the liquid discharge apparatus of the above-described aspect, when a sixth liquid having a fifth viscosity which is a viscosity higher than the second viscosity is supplied to the liquid discharge head, the control device may further control the circulation mechanism so that the circulation flow rate of the sixth liquid is an eighth flow rate higher than the fourth flow rate. According to the liquid discharge apparatus of this aspect, even when the liquids having three or more different types of viscosities are supplied to the liquid discharge head, while the thickening can be prevented by circulating the liquid, deterioration of the performance of the liquid can be prevented.

13. In the liquid discharge apparatus of the above-described aspect, when the discharge rate per unit time of the first liquid is set to the first discharge rate, the control device may control the circulation mechanism so that the circulation flow rate of the first liquid is the first flow rate. When the discharge rate of the first liquid is set to a second discharge rate higher than the first discharge rate, the control device may control the circulation mechanism so that the circulation flow rate of the first liquid is a sixth flow rate higher than the first flow rate. According to the liquid discharge apparatus of this aspect, while deterioration of the performance of the first liquid can be prevented, it is possible to more reliably reduce or prevent occurrence of the thickening of the first liquid by increasing the circulation amount.

14. In the liquid discharge apparatus of the above-described aspect, wherein when the discharge rate per unit time of the fourth liquid is set to a fifth discharge rate, the control device may control the circulation mechanism so that the circulation flow rate of the fourth liquid is the fourth flow rate. When the discharge rate of the fourth liquid is set to a sixth discharge rate higher than the fifth discharge rate, the control device may control the circulation mechanism so that the circulation flow rate of the fourth liquid is a ninth flow rate higher than the fourth flow rate. According to the liquid discharge apparatus of this aspect, while deterioration of the performance of the fourth liquid can be prevented, it is possible to more reliably reduce or prevent occurrence of the thickening by increasing the circulation amount of the fourth liquid.

15. In the liquid discharge apparatus of the above-described aspect, both the first liquid and the fourth liquid may be supplied to one of the liquid discharge heads. According to the liquid discharge apparatus of this aspect, even when the plurality of types of liquids are supplied, while the thickening of the liquid can be prevented in accordance with the type of the supplied liquid, deterioration of the performance of the liquid can be prevented.
16. The liquid discharge apparatus of the above-described aspect may further include a plurality of the liquid discharge heads including a first liquid discharge head to which the first liquid is supplied, and a second liquid discharge head to which the fourth liquid is supplied, the second liquid discharge head being different from the first liquid discharge head. According to the liquid discharge apparatus of this aspect, the different liquid discharge head can be used for each type of the liquids. Accordingly, compared to an aspect in which the plurality of types of liquids are supplied to one liquid discharge head, conditions of the circulation flow rates and the discharge rates are easily switched for each type of the liquids.
17. In the liquid discharge apparatus of the above-described aspect, when a probability that the particle exists per unit volume of the liquid is defined as a particle existence probability, in a case where the first liquid is supplied to the liquid discharge head at the first flow rate, the particle existence probability of the first liquid in the nozzle may be 60% or higher. When the fourth liquid is supplied to the liquid discharge head at the fourth flow rate, the particle existence probability of the fourth liquid in the nozzle may be 60% or higher. According to the liquid discharge apparatus of this aspect, it is possible to reduce or prevent deterioration of the performance of the first liquid and the fourth liquid.
18. In the liquid discharge apparatus of the above-described aspect, when the fourth liquid is supplied to the liquid discharge head at the first flow rate, the particle existence probability of the fourth liquid in the nozzle may be lower than 60%. According to the liquid discharge apparatus of this aspect, it is possible to reduce or prevent deterioration of the performance of the fourth liquid.

The present disclosure can also be realized in various aspects in addition to the liquid discharge apparatus. For example, the present disclosure can be realized in aspects such as a manufacturing method for the liquid discharge apparatus, a control method for the liquid discharge apparatus, a computer program for realizing the control method, and a non-temporary recording medium on which the computer program is recorded.

The present disclosure is not limited to the ink jet type, and is also applicable to any liquid discharge apparatus that discharges a liquid other than the ink and a liquid discharge head used for the liquid discharge apparatus. For example, the present disclosure is applicable to various liquid discharge apparatuses and liquid discharge heads as follows.

1. An image recording apparatus such as a facsimile machine.
2. A color material discharge apparatus used for manufacturing a color filter for an image display device such as a liquid crystal display.
3. An electrode material discharge apparatus used for forming an electrode of an organic electro luminescence (EL) display and a field emission display (FED).
4. A liquid discharge apparatus that discharges a liquid containing a bioorganic substance used for manufacturing a biochip.
5. A sample discharge apparatus serving as a precision pipette.
6. A discharge apparatus of lubricating oil.
7. A discharge apparatus of a resin liquid.
8. A liquid discharge apparatus that discharges lubricating oil in a pinpoint manner to a precision machine such as a timepiece and a camera.
9. A liquid discharge apparatus that discharges a transparent resin liquid such as an ultraviolet curable resin liquid onto a substrate in order to form a micro hemispherical lens (optical lens) used for an optical communication element.
10. A liquid discharge apparatus that discharges an acidic or alkaline etching solution for etching a substrate.
11. A liquid discharge apparatus including a liquid consumption head that discharges any other droplet having a minute amount.

The "droplet" refers to a state of the liquid discharged from the liquid discharge apparatus, and includes those which leave a tail in a granular shape, a tear shape, or a thread shape. In addition, the "liquid" as used herein may be any desired material that can be consumed by the liquid discharge apparatus. For example, the "liquid" may be any desired material in a state where a substance is in a liquid phase. A material in a liquid state having a high or low viscosity, or a material in a liquid state such as sol, gel water, other inorganic solvent, organic solvent, solution, liquid resin, and liquid metal (metal melt) are also included in the "liquid". In addition, not only a liquid as a state of a substance, but also those in which a particle of a functional material formed of a solid substance such as a pigment or a metal particle are dissolved, dispersed, or mixed in a solvent are included in the "liquid". In addition, a typical example of the liquid includes the ink as in the above-described embodiments or liquid crystal.

What is claimed is:

1. A liquid discharge apparatus comprising:

a liquid discharge head that discharges a liquid containing a particle;

a circulation mechanism that adjusts a flow rate of the liquid circulated in the liquid discharge head; and a control device that controls an operation of the circulation mechanism, wherein the liquid discharge head includes a pressure chamber for applying a pressure to the liquid, a supply flow path communicating with the pressure chamber, a nozzle flow path communicating with the supply flow path, a nozzle provided in the nozzle flow path to discharge the liquid by the pressure applied in the pressure chamber, and a discharge flow path coupled to an opposite side via the nozzle in the nozzle flow path, when a first liquid containing the particles whose particle size average value is a first particle size is supplied to the liquid discharge head, the control device controls the circulation mechanism so that a circulation flow rate of the first liquid in the supply flow path, the nozzle flow path, and the discharge flow path is a first flow rate, and when a second liquid containing the particles whose particle size average value is a second particle size larger than the first particle size is supplied to the liquid discharge head, the control device controls the circulation mechanism so that the circulation flow rate of the second liquid is a second flow rate lower than the first flow rate.

2. The liquid discharge apparatus according to claim 1, wherein when a third liquid containing the particles whose particle size average value is a third particle size larger than the second particle size is supplied to the liquid discharge head, the control device further controls the circulation mechanism so that the circulation flow rate of the third liquid is a third flow rate lower than the second flow rate.

3. The liquid discharge apparatus according to claim 1, wherein when a fourth liquid containing the particles whose particle size average value is the first particle size and having a second viscosity higher than a first viscosity of the first liquid is supplied to the liquid discharge head, the control device further controls the circulation mechanism so that the circulation flow rate is a fourth flow rate higher than the first flow rate.

4. The liquid discharge apparatus according to claim 1, wherein when a fifth liquid containing the particles whose particle size average value is the second particle size and having a fourth viscosity higher than a third viscosity which is a viscosity of the second liquid is supplied to the liquid discharge head, the control device further controls the circulation mechanism so that the circulation flow rate is a fifth flow rate higher than the second flow rate.

5. The liquid discharge apparatus according to claim 1, wherein when a discharge rate per unit time of the first liquid is set to a first discharge rate, the control device controls the circulation mechanism so that the circulation flow rate of the first liquid is the first flow rate, and when the discharge rate of the second liquid is set to a second discharge rate higher than the first discharge rate, the control device controls the circulation mechanism so that the circulation flow rate of the second liquid is a sixth flow rate higher than the first flow rate.

6. The liquid discharge apparatus according to claim 1, wherein when a discharge rate per unit time of the second liquid is set to a third discharge rate, the control device controls the circulation mechanism so that the circulation flow rate of the second liquid is the second flow rate, and when the discharge rate of the second liquid is set to a fourth discharge rate higher than the third discharge rate, the control device controls the circulation mechanism so that the circulation flow rate is a seventh flow rate higher than the second flow rate.

7. The liquid discharge apparatus according to claim 1, wherein both the first liquid and the second liquid are supplied to one of the liquid discharge heads.

8. The liquid discharge apparatus according to claim 1, further comprising:

a plurality of the liquid discharge heads including a first liquid discharge head to which the first liquid is supplied, and a second liquid discharge head to which the second liquid is supplied, the second liquid discharge head being different from the first liquid discharge head.

9. The liquid discharge apparatus according to claim 1, wherein when a probability that the particle exists per unit volume of the liquid is defined as a particle existence probability, in a case where the first liquid is supplied to the liquid discharge head at the first flow rate, the particle existence probability of the first liquid in the nozzle is 60% or higher, and when the second liquid is supplied to the liquid discharge head at the second flow rate, the particle existence probability of the second liquid in the nozzle is 60% or higher.

10. The liquid discharge apparatus according to claim 9, wherein when the second liquid is supplied to the liquid discharge head at the first flow rate, the particle existence probability of the second liquid in the nozzle is lower than 60%.

11. A control method for a liquid discharge apparatus, comprising:

setting a circulation flow rate of a first liquid inside a liquid discharge head to a first flow rate, when the first liquid is supplied to the liquid discharge head, the first liquid containing particles whose particle size average value is a first particle size; and setting a circulation flow rate of a second liquid inside the liquid discharge head to a second flow rate lower than the first flow rate, when the second liquid is supplied to the liquid discharge head, the second liquid containing particles whose particle size average value is a second particle size larger than the first particle size.

* * * * *